US008019253B2

(12) United States Patent
Hashimoto

(10) Patent No.: US 8,019,253 B2
(45) Date of Patent: Sep. 13, 2011

(54) IMAGE FORMING APPARATUS

(75) Inventor: Junichi Hashimoto, Toyohashi (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 181 days.

(21) Appl. No.: 12/408,198

(22) Filed: Mar. 20, 2009

(65) Prior Publication Data

US 2009/0269100 A1 Oct. 29, 2009

(30) Foreign Application Priority Data

Apr. 25, 2008 (JP) ..... 2008-115403

(51) Int. Cl.
*G03G 21/18* (2006.01)

(52) U.S. Cl. ..... 399/114

(58) Field of Classification Search ..... 399/107, 399/110, 111–114
See application file for complete search history.

(56) References Cited

U.S. PATENT DOCUMENTS 6,032,002 A * 2/2000 Yokomori et al. ..... 399/12
7,010,244 B2 3/2006 Kang et al.
7,020,417 B2 * 3/2006 Nomura et al. ..... 399/111
7,286,787 B2 * 10/2007 Baek et al. ..... 399/114
2006/0067734 A1 3/2006 Igarashi et al.
2007/0264032 A1 * 11/2007 Harumoto ..... 399/12

FOREIGN PATENT DOCUMENTS

JP 2005-043899 2/2005
JP 2006-098772 4/2006
JP 2007-147715 6/2007

* cited by examiner

*Primary Examiner* — Hoan Tran
(74) *Attorney, Agent, or Firm* — Banner & Witcoff, Ltd.

(57) ABSTRACT

An image forming apparatus is provided. The image forming apparatus includes a casing, a photosensitive unit removably mountable in the casing, and a protective member. The photosensitive unit includes a plurality of photosensitive members. The protective member is removably attached to the photosensitive unit and includes: a covering plate which opposes the plurality of photosensitive members to cover the plurality of photosensitive members when protecting the photosensitive members; a written part arranged on the covering plate, and including operation information related to the image forming apparatus written thereon; and a support part which supports the photosensitive unit so that the photosensitive members and the covering plate are separated by an interval when protecting the photosensitive members.

20 Claims, 10 Drawing Sheets

UPPER
LOWER
LEFT
RIGHT
42
43
35R (35)
35F (35)
33
35B (35)
39
38
35B (35)
35F (35)
35L (35)
42
43

UPPER
LOWER
FRONT
BACK
41
20
35R (35)
42
43
46
34
42
43
33
17
42
43
42
43
45
39
38
35F (35)

UPPER
LOWER
RIGHT
LEFT
42
43
35L (35)
41
35F (35)
38
39
35B (35)
33
35F (35)
42
43
35R (35)

IMAGE FORMING APPARATUS

CROSS-REFERENCE TO RELATED APPLICATION

This application claims priority from Japanese Patent Application No. 2008-115403, filed on Apr. 25, 2008, the entire subject matter of which is incorporated herein by reference.

TECHNICAL FIELD

Aspects of the present invention relate to an image forming apparatus such as a laser printer and a photosensitive unit set for the image forming apparatus.

BACKGROUND

A tandem type color laser printer includes a plurality (four) of photosensitive drums and developing rollers for respective colors, i.e., yellow, magenta, cyan, and black.

In the tandem type color laser printer, a toner image of each color is formed on the corresponding photosensitive drum by the corresponding developing roller substantially simultaneously, and thereafter, each toner image is transferred on a sheet or an intermediate transfer belt. Accordingly, a color image can be formed at substantially same speed as that of a monochrome laser printer.

As such a tandem type color laser printer, for example, JP-A-2006-98772 describes that an image forming unit including a plurality of photosensitive drums and developing cartridges can be pulled from and removably mounted on a main body casing.

SUMMARY

When a user handles the image forming unit at the time of replacing the photosensitive drum or the developing cartridge, for example, it is necessary to present operation information about the image forming unit to suppress an erroneous operation. It might be advantageous to write such operation information inside the main body casing or in the image formation unit itself.

However, various types of components are effectively installed inside the main body casing and in the image forming unit, and thus, it is difficult to secure a sufficient area for presenting being written with the operation information.

On the other hand, if a member for being written with the operation information is separately arranged, this would lead an increase in the number of components, a rise in cost, and enlargement of the apparatus.

Accordingly, it is an aspect of the present invention to provide an image forming apparatus capable of presenting operation information in a wide area without the need for providing a component for being written with the operation information, thereby suppressing an erroneous operation by a user.

According to an exemplary embodiment of the present invention, there is provided an image forming apparatus comprising: a casing; a photosensitive unit removably mountable in the casing, and comprising a plurality of photosensitive members; and a protective member removably attached to the photosensitive unit, and configured to protect the plurality of photosensitive members, the protective member comprising: a covering plate which opposes the plurality of photosensitive members to cover the plurality of photosensitive members when protecting the photosensitive members; a written part arranged on the covering plate, and including operation information related to the image forming apparatus written thereon; and a support part which supports the photosensitive unit so that the photosensitive members and the covering plate are separated by an interval when protecting the photosensitive members.

According to another exemplary embodiment of the present invention, there is provided a photosensitive unit set comprising: a photosensitive unit removably mountable in a casing of an image forming apparatus, the casing comprising a storing part, the photosensitive unit comprising: a body; and a plurality of photosensitive drums rotatably supported by the body, each photosensitive drum includes an exposed portion which is exposed from the body; and a protective member removably attached to the body, opposing the exposed portions of the plurality of photosensitive drums to protect the exposed portions when attached to the body, the protective member being adapted to be stored in the storing part of the casing when removed from the body.

DETAILED DESCRIPTION

1. Overall Configuration of a Color Laser Printer

Figure 1:
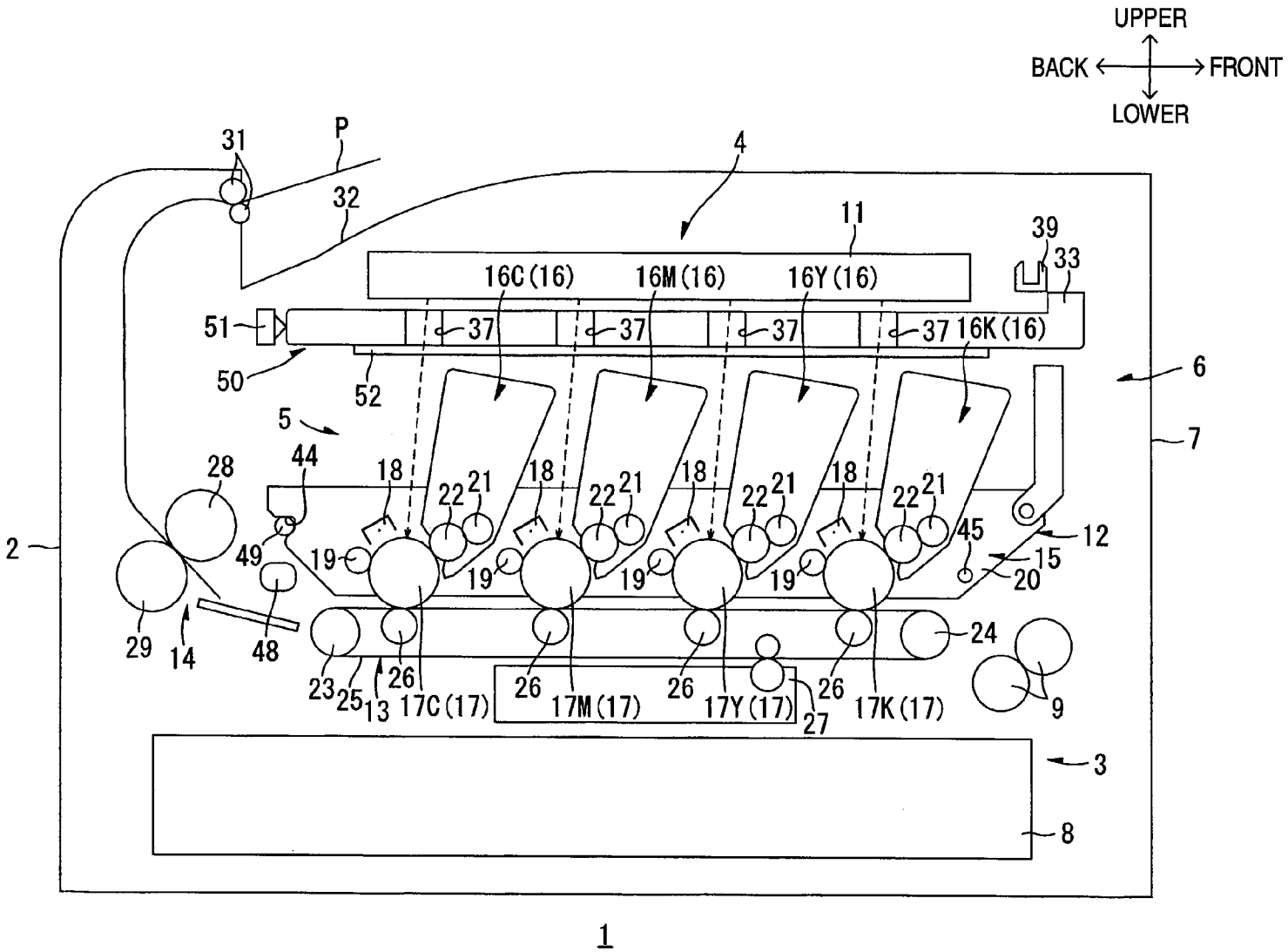
FIG. 1 is a sectional side view showing a color laser printer according to an exemplary embodiment of the present invention.

FIG. 1 is a sectional side view showing a color laser printer (an example of an image forming apparatus) according to an exemplary embodiment of the present invention.

A color laser printer 1 is a horizontally-placed tandem-type color laser printer. Within a main body casing 2 (an example of a casing), there are provided a feeder unit 3 for feeding a sheet P, and an image forming unit 4 for forming an image on the fed sheet P.

(1) Main Body Casing

The main body casing 2 has a box shape with a substantially rectangular shape in side view. Inside of the main body casing 2, a process-cartridge accommodating space 5 for accommodating a process cartridge 12 described later is formed.

Figure 6:
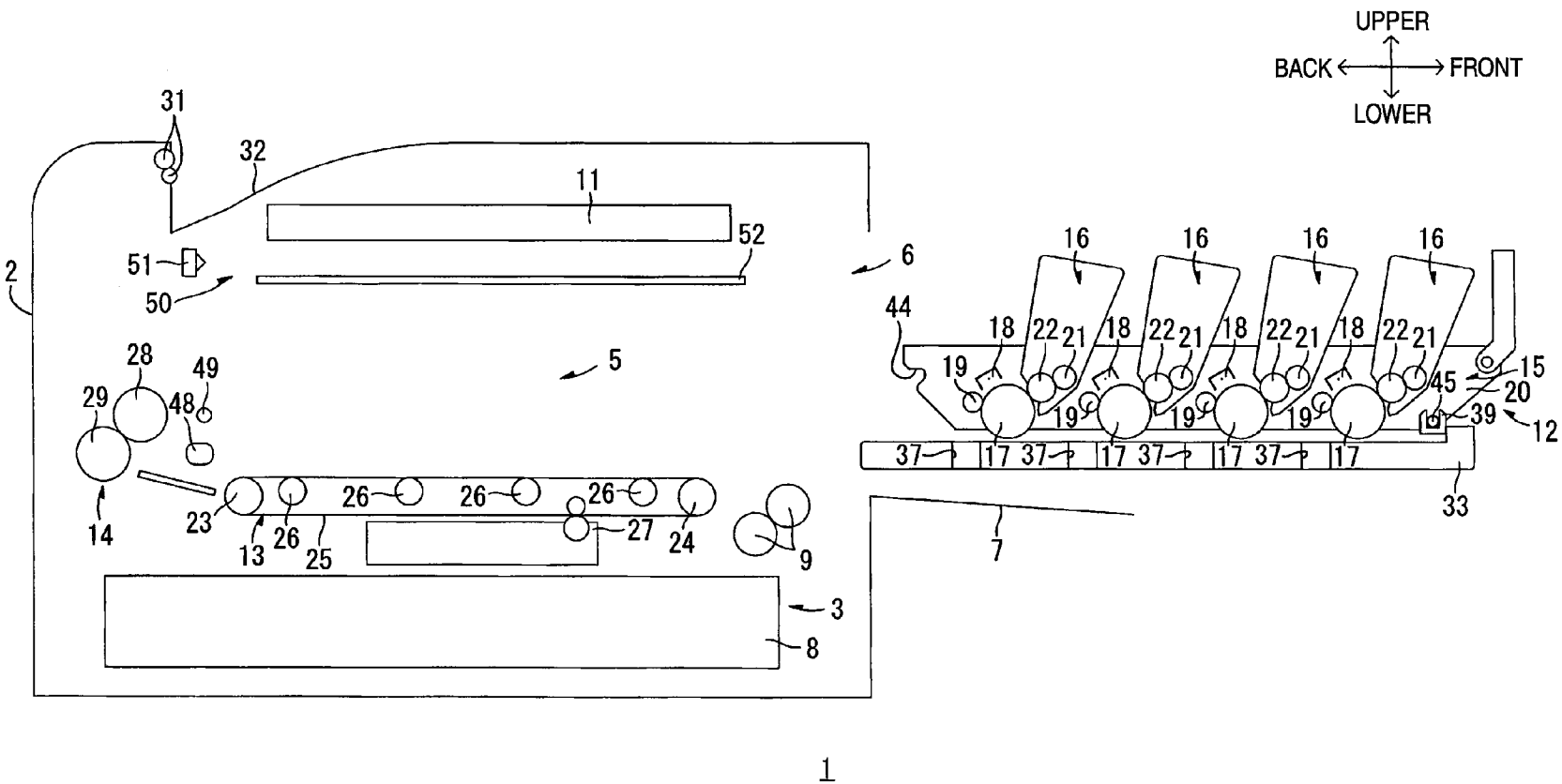
FIG. 6 is a diagram showing a step of inserting the process cartridge into the process-cartridge accommodating space in a step of mounting the process cartridge to a main body casing.

One side surface of the main body casing 2 is formed with a removable port 6 that communicates to the process-cartridge accommodating space 5 (see FIG. 6). On the side surface on which the removable port 6 is formed, a front cover 7 for opening and closing the removable port 6 is provided (see FIG. 6). In a state that the front cover 7 is inclined frontward from the main body casing 2 so as to open the removable port 6, the process cartridge 12 can be mounted to and removed from the process-cartridge accommodating space 5 via the removable port 6 (see FIG. 6).

It is noted that in the following descriptions, the side (right side in FIG. 1) on which the front cover 7 is arranged is referred to as a front side, and the opposite side (left side in FIG. 1) is referred to as a back side. Right and left is determined when the color laser printer 1 is seen from the front side. That is, in FIG. 1, the near side (toward the viewer) is the left side and the far side (away from the viewer) is the right side. It is noted that the right-left direction may be referred to as a width direction. With respect to a drum unit 15 (described later) and a developing cartridge 16 (described later), the front, back, right, left, upper, and lower are defined in a mounted state to the main body casing 2, unless otherwise specified.

(2) Feeder Unit

The feeder unit 3 includes a sheet feed tray 8 for accommodating the sheet P. The sheet feed tray 8 is removably mounted at the bottom within the main body casing 2. Above the front end portion of the sheet feed tray 8, a sheet feed roller (not shown) is provided, and on the back side of the sheet feed roller (not shown), a registration roller 9 is provided.

With the rotation of the sheet feed roller (not shown), the sheets P accommodated in the sheet feed tray 8 are fed one by one toward the registration roller 9. Thereafter, the sheet P is conveyed by the registration roller 9 toward the image forming unit 4 (between the photosensitive drum 17 and a conveying belt 25).

(3) Image Forming Unit

The image forming unit 4 includes a scanner unit 11 (an example of an exposure unit), a process cartridge 12, a transfer part 13, and a fixing unit 14.

(3-1) Scanner Unit

The scanner unit 11 is placed at the upper part of the main body casing 2. The scanner unit 11 opposes the four photosensitive drums 17 (described later) in the front-back and right-left directions, and is placed along the front-back and right-left directions. The scanner unit 11 includes four windows (not shown) for emitting a laser beam to the four photosensitive drums 17 (described later). The four windows are arranged in parallel with each other to be spaced apart along the front-back direction. As shown by chain lines, thorough each of the windows a laser beam is emitted based on image data toward the corresponding photosensitive drums 17 to expose.

(3-2) Process Cartridge

The process cartridge 12 is arranged below the scanner unit 11 and above the feeder unit 3. The process cartridge 12 includes one drum unit 15 (an example of a photosensitive unit) and four developing cartridges 16 corresponding to respective colors. Moreover, the process cartridge 12 is removably mounted (arranged) in the main body casing 2 to be inserted and pulled out along the front-back direction.

(3-2-1) Drum Unit

The drum unit 15 includes the four photosensitive drums 17 (an example of a photosensitive member) corresponding to respective colors; four scorotron chargers 18; and four cleaning brushes 19, corresponding to respective photosensitive drums 17.

Each photosensitive drum 17 is arranged along the right-left direction between two side plates 20 (described later), which are placed opposite to each other and spaced apart in the right-left direction. The photosensitive drums 17 are supported to be freely rotatable relative to the side plates 20 (described later).

Each photosensitive drum 17 is arranged in parallel with each other and aligned in the front-back direction to be spaced apart from each. Specifically, a black photosensitive drum 17K, a yellow photosensitive drum 17Y, a magenta photosensitive drum 17M, and a cyan photosensitive drum 17C are placed sequentially from the front side toward the back side.

Each scorotron charger 18 is arranged to be spaced apart from and oppose each photosensitive drum 17, obliquely on the upper back side of each photosensitive drum 17.

Each cleaning brush 19 is arranged to oppose and contact the corresponding photosensitive drum 17 at the back thereof. Each scorotron charger 18 and each cleaning brush 19 are supported on a center frame (not shown) that is provided across between the two side plates 20.

(3-2-2) Developing Cartridge

The four developing cartridges 16 are arranged removably in the drum unit 15 to correspond to the four photosensitive drums 17. That is, the developing cartridges 16 includes four cartridges, i.e., a black developing cartridge 16 K mounted corresponding to the black photosensitive drum 17K; a yellow developing cartridge 16Y mounted corresponding to the yellow photosensitive drum 17Y; a magenta developing cartridge 16M mounted corresponding to the magenta photosensitive drum 17M; and a cyan developing cartridge 16C mounted corresponding to the cyan photosensitive drum 17C.

Each developing cartridge 16 includes a supply roller 21, a developing roller 22, and a layer-thickness regulating blade (not shown), and accommodates toner of corresponding color.

The supply roller 21 and the developing roller 22 are arranged below a toner accommodating chamber (not shown) within the developing cartridge 16 and are provided in a manner to pressure-contact each other.

(3-2-3) Developing Operation of the Process Cartridge

The toner in the developing cartridge 16 is supplied to the supply roller 21, and then supplied to the developing roller 22 by the rotation of the supply roller 21. At this time, the toner is frictionally charged with a positive polarity between the supply roller 21 and the developing roller 22.

Along with the rotation of the developing roller 22, the toner that is supplied to the developing roller 22 is regulated in thickness by the layer-thickness regulating blade (not shown), and the resultant toner is held, as a constant thickness thin layer of toner, on the surface of the developing roller 22.

On the other hand, along with the rotation of the photosensitive drums 17, the surface of a photosensitive drum 17 corresponding to each developing cartridge 16 is uniformly charged positively by the scorotron charger 18, and thereafter, the surface is exposed by a high-speed scanning by a laser beam (see illustrated dotted lines) from the scanner unit 11.

Accordingly, an electrostatic latent image corresponding to an image to be formed on the sheet P is formed on the surface of each photosensitive drum 17.

When each photosensitive drum 17 rotates further, the positively charged toner that is held on the surface of the developing roller 22 is supplied to the electrostatic latent image that is formed on the surface of each photosensitive drum 17. Accordingly, the electrostatic latent images on the photosensitive drums 17 for respective colors are developed into a visible image, and the toner image by a reverse development is carried on the surface of each photosensitive drum 17.

(3-3) Transfer Part

The transfer part 13 is arranged above the feeder unit 3 in the main body casing 2 and along the front-back direction below the process cartridge 12. This transfer part 13 includes: a drive roller 23; a follower roller 24; a conveying belt 25; transfer rollers 26; and a cleaning part 27.

The drive roller 23 and the follower roller 24 are arranged to oppose to each other to be spaced apart in the front-back direction. The conveying belt 25 made of an endless belt is wound around the drive roller 23 and the follower roller 24.

Each transfer roller 26 is arranged to oppose the corresponding photosensitive drum 17 with the conveying belt 25 being sandwiched therebetween.

The cleaning part 27 is arranged below the conveying belt 25 that is wound around the drive roller 23 and the follower roller 24.

The sheet P fed from the feeder unit 3 is conveyed on the conveying belt 25 from the front side toward the back side to sequentially pass through transfer positions for respective photosensitive drums 17. During the conveyance, the toner images of respective colors that are carried on the photosensitive drums 17 are transferred sequentially. Accordingly, a color image is formed on the sheet P.

On the other hand, during the aforementioned transfer operation, the toner deposited on the surface of the conveying belt 25 is eliminated by the cleaning part 27.

(3-4) Fixing Unit

The fixing unit 14 is arranged at the back of the transfer part 13, and includes a heating roller 28 and a pressure roller 29 opposing the heating roller 28. In the transfer part 13, the color image transferred to the sheet P is heated and pressurized while the sheet P passes through between the heating roller 28 and the pressure roller 29 so as to be thermally fixed on the sheet P.

(4) Sheet Discharge

The sheet P on which the toner image is fixed is conveyed toward a sheet discharge roller 31, and discharged by the sheet discharge roller 31 onto a sheet discharge tray 32 formed on the top surface of the main body casing 2.

2. Photosensitive Drum Cover and Configuration Associated Therewith

Figure 2:
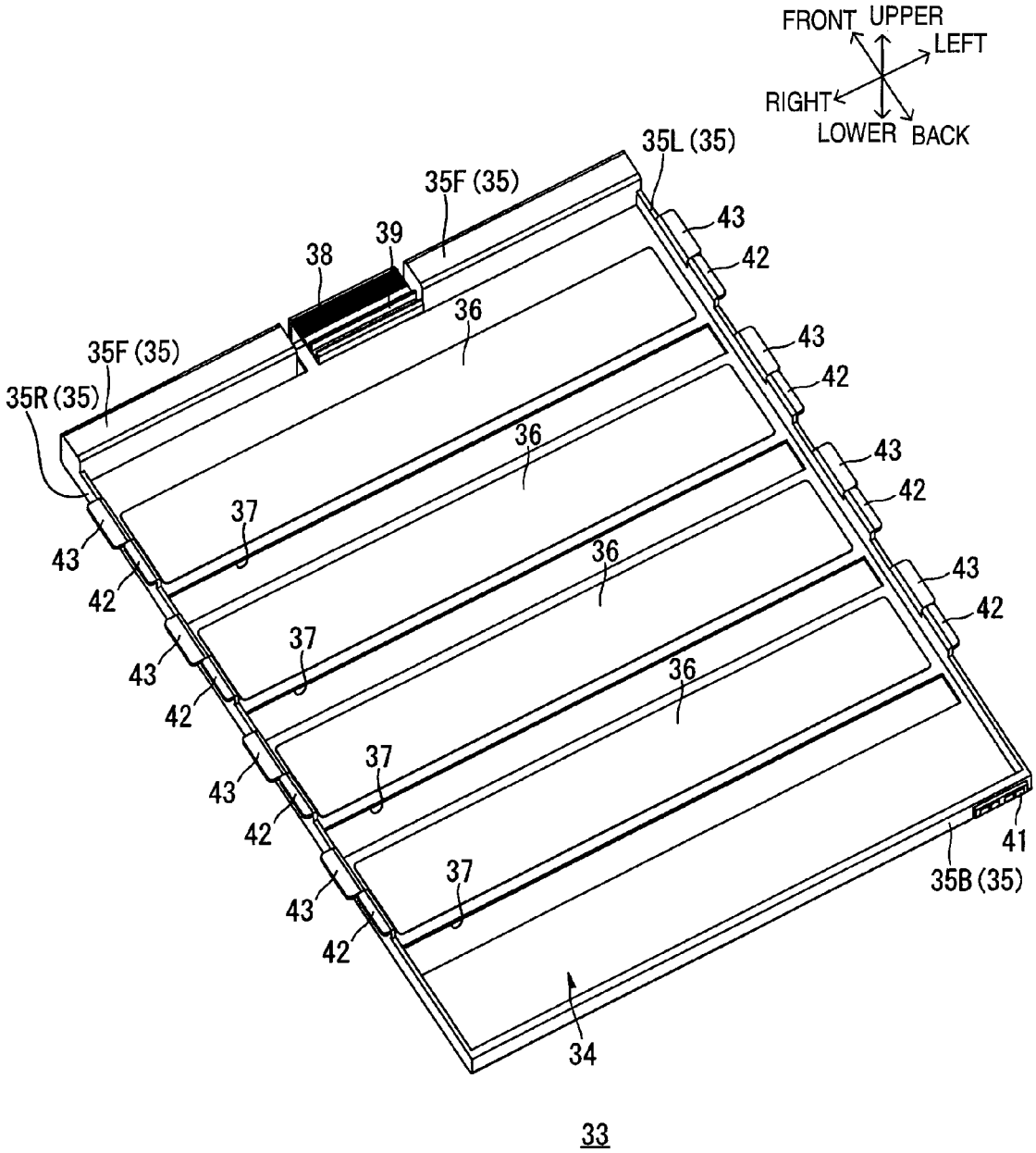
FIG. 2 is a perspective view of a photosensitive drum cover shown in FIG. 1 as seen from the right back side.
Figure 3:
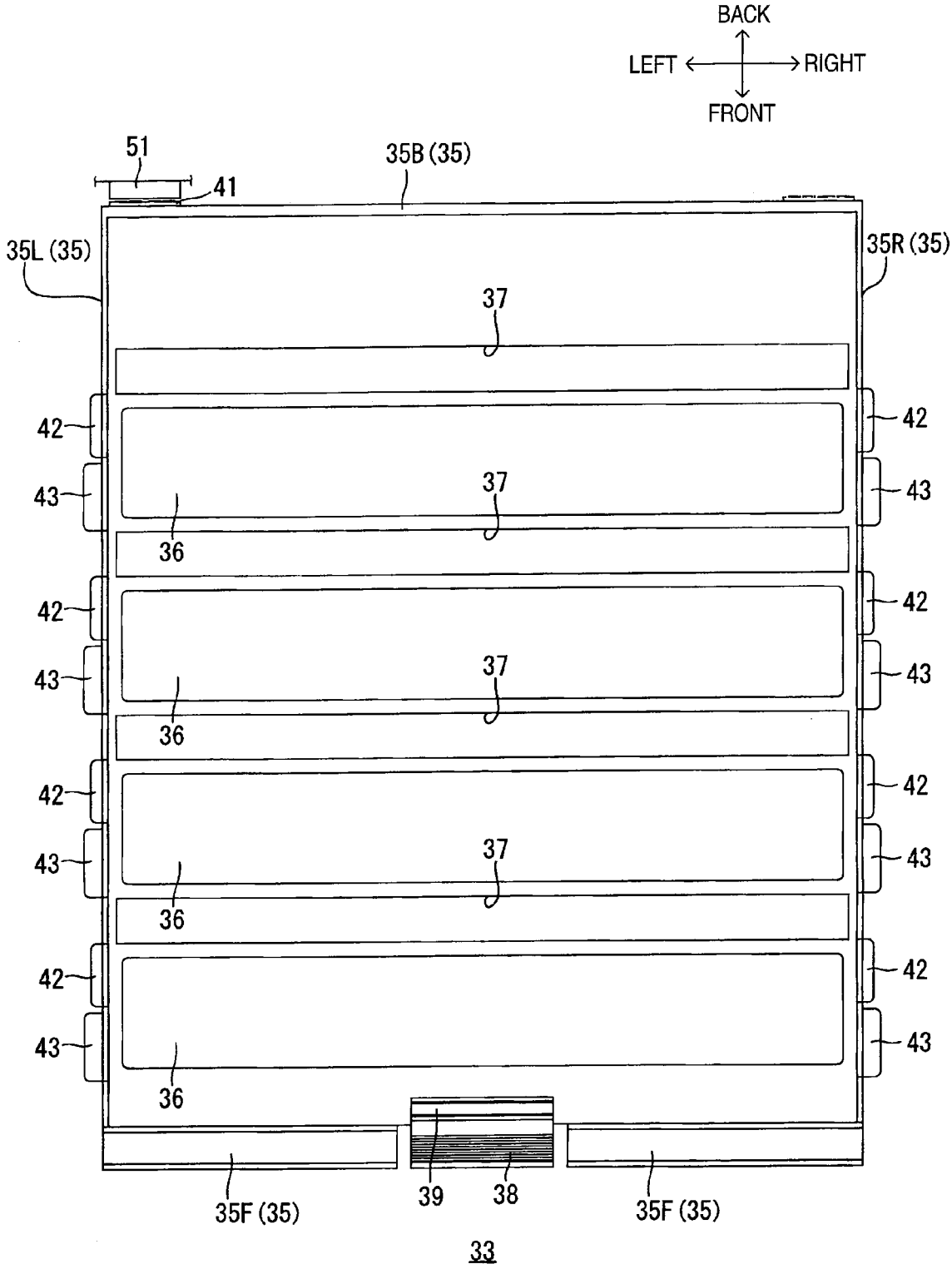
FIG. 3 is a plan view of the photosensitive drum cover shown in FIG. 1.
Figures 4A, 4B, 4C:
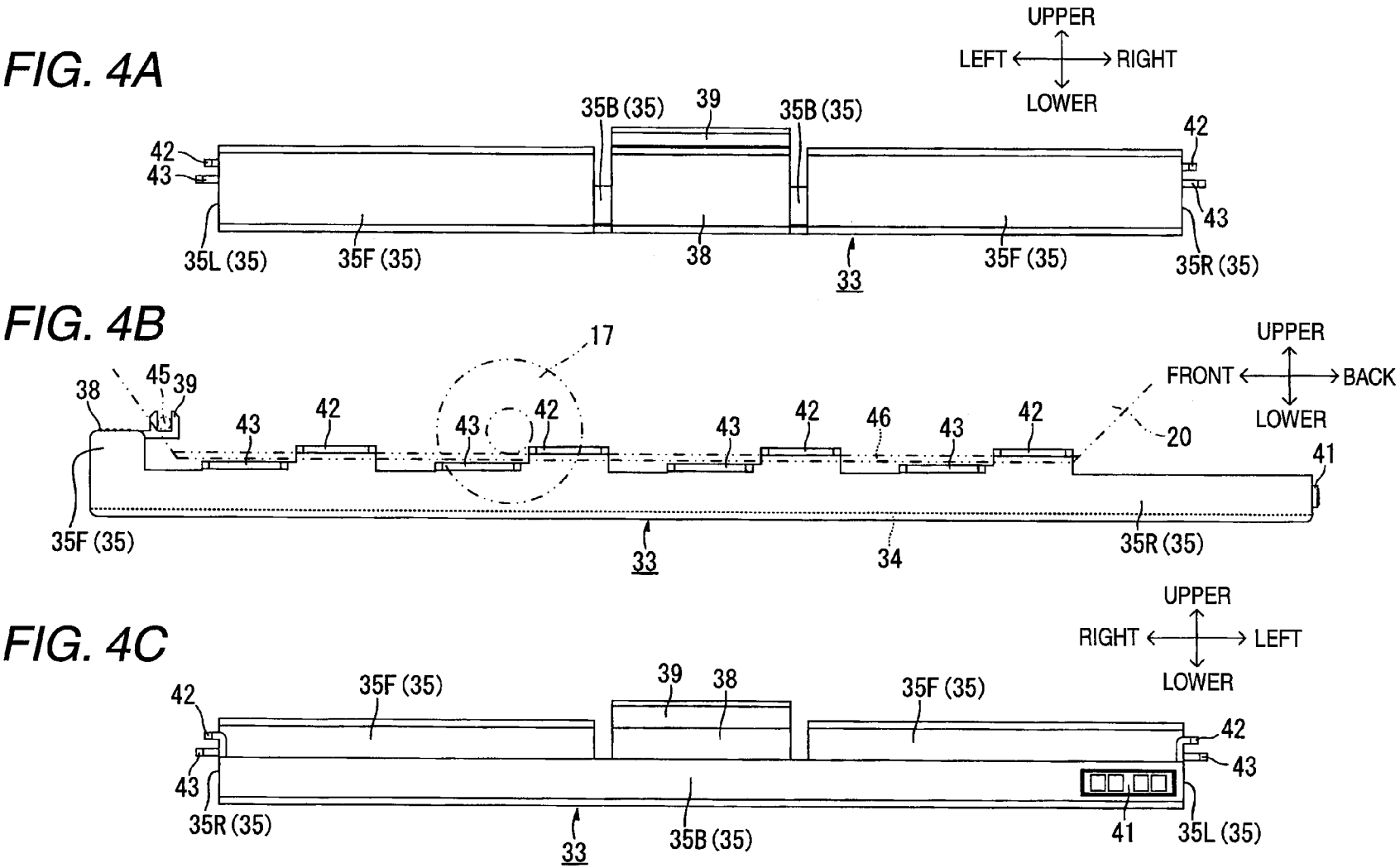
FIG. 4A is a front view of the photosensitive drum cover shown in FIG. 1.
FIG. 4B is a right side view of the photosensitive drum cover shown in FIG. 1.
FIG. 4C is a rear view of the photosensitive drum cover shown in FIG. 1.

FIG. 2 is a perspective view of a photosensitive drum cover 33 shown in FIG. 1 as seen from the right back side. FIG. 3 is a plan view of the photosensitive drum cover 33 shown in FIG. 1. FIG. 4A is a front view of the photosensitive drum cover 33 shown in FIG. 1, FIG. 4B is a right side view of the photosensitive drum cover 33 shown in FIG. 1, and FIG. 4C is a rear view of the photosensitive drum cover 33 shown in FIG. 1.

(1) Photosensitive Drum Cover

At the time of shipment from a factory, in the color laser printer 1, the process cartridge 12 is packed separately from the main body casing 2 as shown in FIG. 6. At this time, the process cartridge 12 is attached with the photosensitive drum cover 33 for protecting the photosensitive drums 17 (see FIG. 6).

As shown in FIG. 2, the photosensitive drum cover 33 has a thick plate shape in a substantially rectangular shape in plan view, and includes a covering plate 34 and peripheral-wall parts 35.

The covering plate 34 extends along the front-back direction as shown in FIG. 3 and has a flat plate shape in a substantially rectangular shape having a size that can cover the four photosensitive drums 17 in plan view. The covering plate 34 includes four operation-information written parts 36 on which operation information related to the color laser printer 1 is written. The covering plate 34 is formed with four exposure holes 37 (an example of an opening) for passing light emitted from the scanner unit 11 toward the photosensitive drums 17. Each exposure hole 37 penetrates through the covering plate 34 in the thickness direction.

The operation-information written parts 36 and the exposure holes 37 are aligned alternately along the front-back direction on the covering plate 34. That is, the operation-information written parts 36 are arranged to be spaced apart from one another along the front-back direction. The exposure holes 37 are also arranged to be spaced apart in the front-back direction. Between each of the adjacent operation-information written parts 36, one exposure hole 37 is arranged, and also, between each of the adjacent exposure holes 37, one operation-information written part 36 is arranged. It is noted that, an operation-information written part 36 is arranged forwardly of an exposure hole 37. The frontmost operation-information written part 36 is arranged to be spaced apart from a front-side wall 35F (described later) in the front-back direction. Moreover, the backmost exposure hole 37 is placed to be spaced apart from a back-side wall 35B (described later).

On the covering plate 34, the operation-information written parts 36 are provided as regions, each having a substantially rectangular shape in plan view and extending in the right-left direction. The region of each operation-information written part 36 has a length in the right-left direction slightly narrower than that of the covering plate 34.

On each operation-information written part 36, operation information about mounting and removing of the process cartridge 12 to and from the main body casing 2, and handling precautions of the color laser printer 1, and the like are described.

On the covering plate 34, each exposure hole 37 is opened in a substantially rectangular shape extending in the right-left direction in plan view. Moreover, each exposure hole 37 is arranged to oppose the corresponding window (not shown) in the upper-lower direction so that a laser beam of the scanner unit 11 is emitted from the exposure hole 37. Moreover, the length in the right-left direction is substantially same as that in the right-left direction of the operation-information written part 36. The length in the front-back direction is about ½ to ¼ of that in the front-back direction of the operation-information written part 36.

As shown in FIG. 2, the peripheral-wall part 35 is formed to continue from the peripheral edge of the covering plate 34, and is erected upwardly to surround the covering plate 34 in plan view. The peripheral-wall part 35 includes a front-side wall 35F, a back-side wall 35B, right-side wall 35R, and left-side wall 35L which are integral.

The front-side wall 35F is arranged on the front edge of the covering plate 34. The front-side wall 35F has a length in the front-back direction and a length in the upper-lower direction longer than those of the back-side wall 35B, the right-side wall 35R, and the left-side wall 35L, as shown in FIG. 3 and FIG. 4A. Specifically, the front-side wall 35F has a length in the front-back direction about 2 to 5 times longer than that of the back-side wall 35B, and has a length in the upper-lower direction about 1.5 to 3 times longer than the back-side wall 35B. In the center part of the front-side wall 35F in the right-left direction, there is formed a notch having a length of about ⅕ length of the front-side wall 35F in the right-left direction. In the center part in the right-left direction, there is formed a handle 38 to be spaced apart from the front-side wall 35F in the right-left direction.

As shown in FIG. 2, the handle 38 continues from the covering plate 34, and has a thin thickness shape in a substantially U shape in cross section, the back side of which is opened. A free end portion (back end portion on the upper side) of the handle 38 is provided with a locking part 39.

The locking part 39 has a substantially U shape in cross section, the upper side of which is opened, as shown in FIG. 4B.

The back-side wall 35B is arranged on the back edge of the covering plate 34, and is provided with a detected part 41, as shown in FIG. 4C.

The detected part 41 is arranged on the left end portion of the back-side wall 35B. The detected part 41 has a substantially rectangular shape in rear view, and extends backwardly from the wall surface of the back-side wall 35B, as shown in FIG. 3. The detected part 41 is provided with an IC chip storing information about a destination (setup region, export country, and the like) of the process cartridge 12 therein.

The right-side wall 35R and the left-side wall 35L are arranged on the right edge and the left edge of the covering plate 34, respectively, and has a length in the upper-lower direction same as that of the back-side wall 35B, as shown in FIG. 4B. The right-side wall 35R and the left-side wall 35L are provided with upper-side support parts 42 and lower-side support parts 43 (an example of a support part) for supporting the process cartridge 12 when the photosensitive drum cover 33 protects the photosensitive drums 17.

Each upper-side support part 42 is arranged as a pair on the right-side wall 35R and the left-side wall 35L opposite to the right-left direction. Four pairs of the upper-side support parts 42 are formed to be spaced apart in the front-back direction so as to correspond to the four photosensitive drums 17. As shown in FIG. 4C, a pair of upper-side support parts 42 extends upwardly from the upper-end surface of the right-side wall 35R and the left-side wall 35L, and then, projects outwardly in the right-left direction to have an L shape in cross section in the right-left direction.

Each lower-side support part 43 is arranged as a pair on the right-side wall 35R and the left-side wall 35L opposite to each other in the right-left direction, similar to the upper-side support part 42, and four pairs of the lower-side support parts 43 are formed to be spaced apart in the front-back direction so as to correspond to the four photosensitive drums 17. A pair of the lower-side support parts 43 is arranged adjacently on the front side of a pair of the upper-side support parts 42. A pair of the lower-side support parts 43 is formed to project outwardly in the right-left direction from the upper-end surface of the right-side wall 35R and the left-side wall 35L. The length in the front-back direction of each lower-side support part 43 is substantially the same as that of each upper-side support part 42. The projected length of the lower-side support part 43 is slightly longer than that of the upper-side support part 42.

Between each upper-side support part 42 and each lower-side support part 43, there is provided a spacing in the up-down direction for slidably holding a rail 46 (described later), as shown by a virtual line in FIG. 4B.

(2) Detail of the Process Cartridge

Figure 5A:
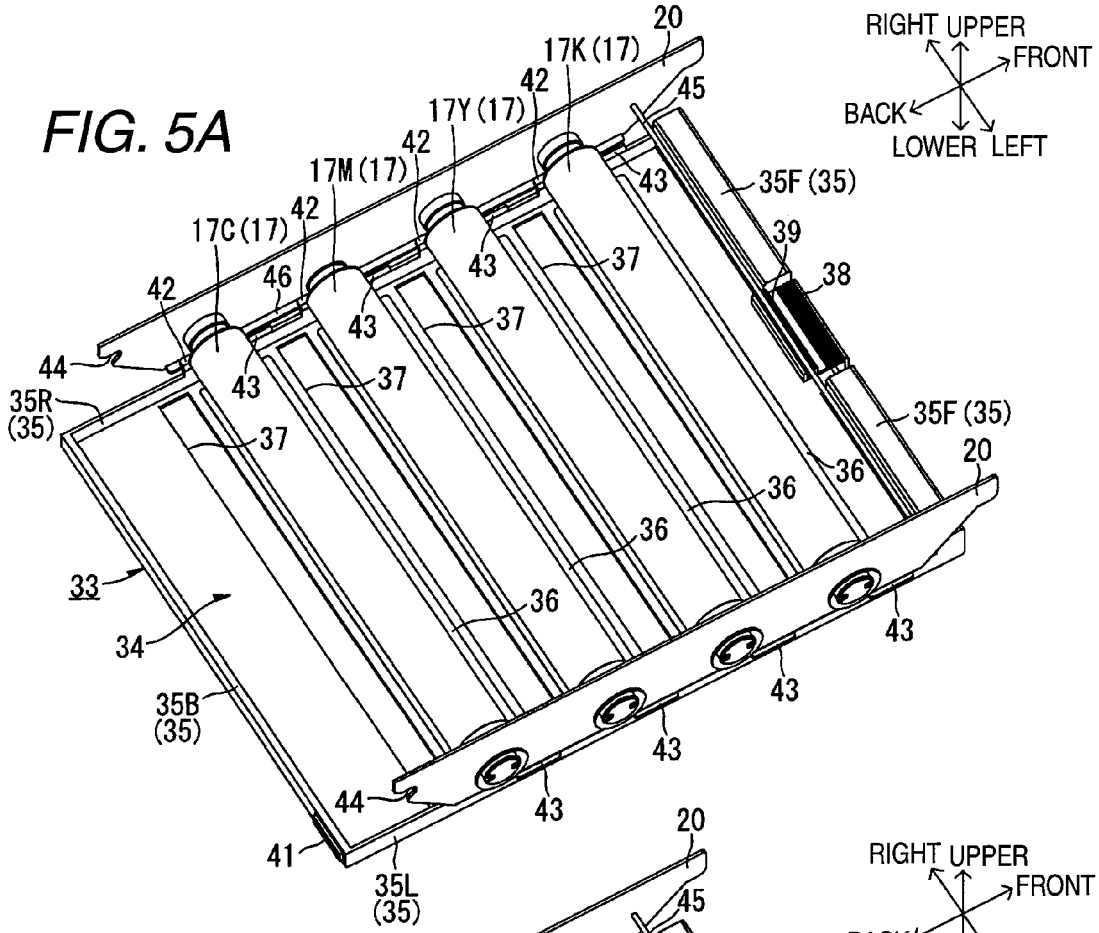
FIG. 5A is a perspective view showing a state that the photosensitive drum cover shown in FIG. 1 is mounted to a process cartridge shown in FIG. 1.
Figure 5B:
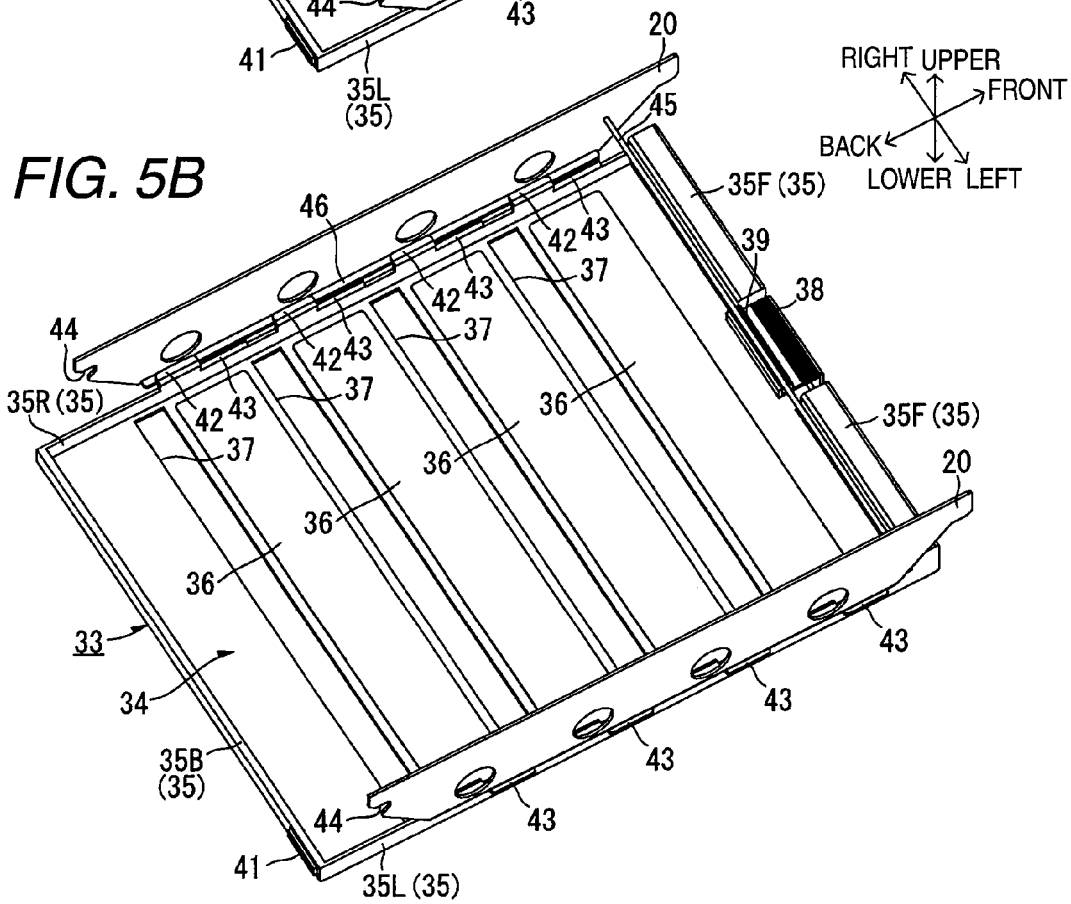
FIG. 5B is a perspective view of a state that the photosensitive drum is extracted in FIG. 5A.

FIG. 5A is a perspective view showing a mounting state of the photosensitive drum cover 33 to the drum unit 15. FIG. 5B is a perspective view showing a state that the photosensitive drum 17 is extracted in FIG. 5A.

It is noted that, regarding the drum unit 15, only the photosensitive drums 17 and the side plates 20 are shown in FIG. 5A, and only side plates 20 are shown in FIG. 5B.

The drum unit 15 is provided with two side plates 20 for rotatably supporting each photosensitive drum 17, as shown in FIG. 5A.

As shown in FIG. 1, each side plate 20 is arranged to oppose each other to be spaced apart in the right-left direction. Each side plate 20 has a substantially rectangular shape in side view, which extends in the front-back direction. The front end portion of each side plate 20 inclines backwardly toward the lower end portion of each side plate 20. The back end portion of each side plate 20 inclines forwardly toward the lower end portion of each side plate 20.

The back end portion of each side plate 20 is formed with a notched part 44 that is notched into a substantially U shape in side view toward the front side from an approximate middle part of the upper-lower direction of the back edge.

The lower end portion of each side plate 20 is formed with the rail 46, which is bent inwardly in the right-left direction so that it has an "L" shape in cross section and which linearly extends along the front-back direction.

Below the front end portion of each side plate 20, there is arranged a locking shaft 45 installed across along the right-left direction between the two side plates 20.

(3) Main Body Casing

The main body casing 2 includes a stopper 48 (an example of a first contact part), a reference shaft 49 (an example of a second contact part), two guide-rails (not shown) for guiding mounting and removing of the process cartridge 12, in the process-cartridge accommodating space 5, as shown in FIG. 1.

The stopper 48 is arranged between the transfer part 13 and the fixing unit 14. The stopper 48 is configured to contact the back end portion of the photosensitive drum cover 33 in mounting the process cartridge 12 to the main body casing 2 (see FIG. 7). The stopper 48 is formed as a rib, which projects in the right-left direction inwardly from the inner-side surface in the right-left direction of the side walls arranged opposite to each other in the width direction in the main body casing 2.

Figure 10:
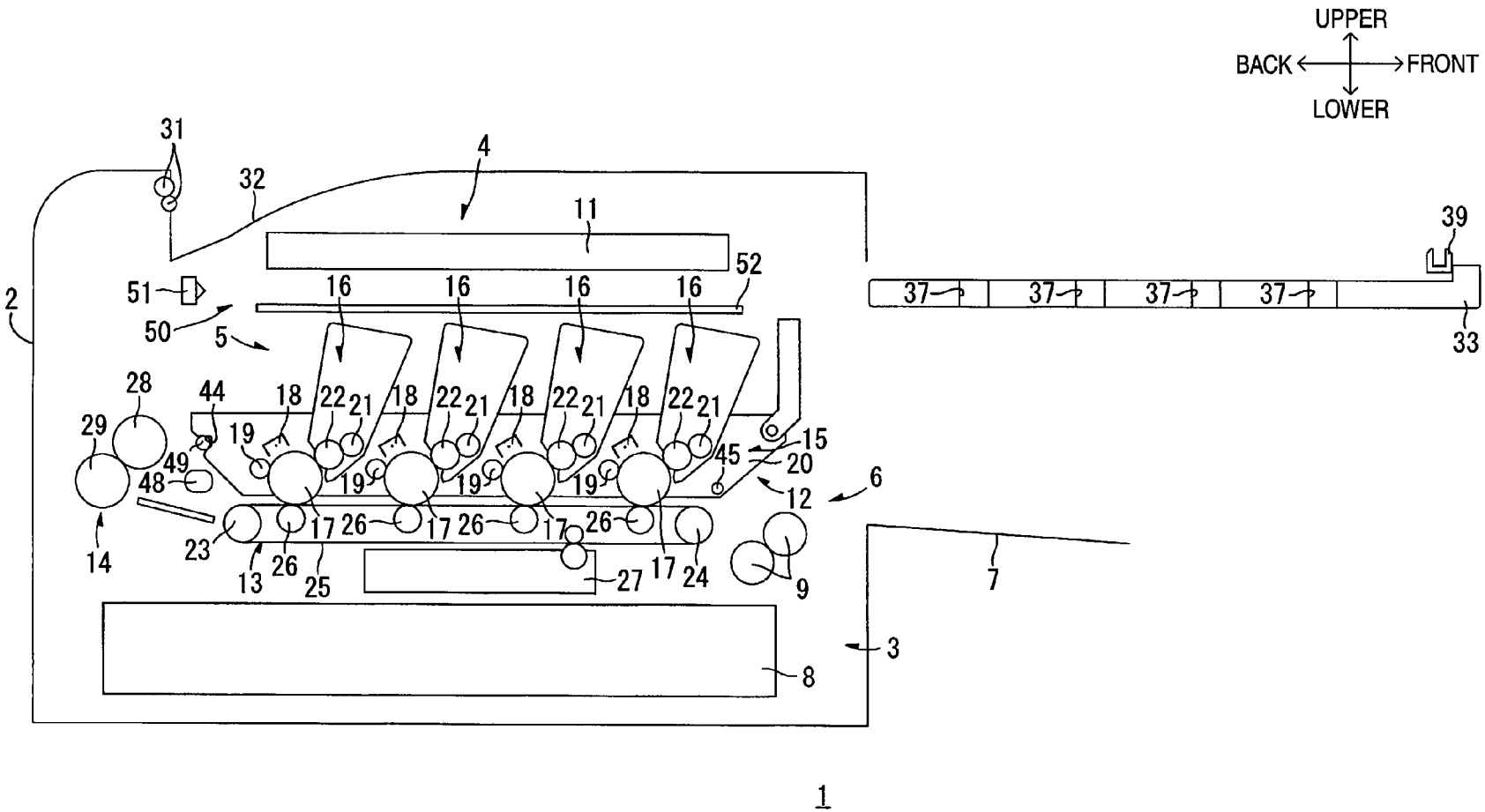
FIG. 10 is a diagram showing a step of setting the process cartridge to the mounting position subsequent to the step of FIG. 9 in the step of mounting a drum unit to the main body casing.

The reference shaft 49 is configured to contact the notched part 44 of the process cartridge 12 when the process cartridge 12 is positioned in the main body casing 2 above the stopper 48 (see FIG. 10). The reference shaft 49 is installed along the right-left direction across between the inner-side surfaces in the right-left direction of each side wall of the main body casing 2.

Each guide-rail projects from the inner-side surface of each side wall of the main body casing 2 inwardly in the right-left direction. Each guide rail is linearly formed along the front-back direction from the front end portion of the main body casing 2 to a position where the back end portion of each side plate 20 is arranged when the back end portion of the photosensitive drum cover 33 contacts the stopper 48 (see FIG. 7) so that the process cartridge 12 can be guided to a mounting preparing position (described later) in the process-cartridge accommodating space 5.

In the main body casing 2, a cover storing part 50 (an example of a storing part) for storing the photosensitive drum cover 33 is provided above the process-cartridge accommodating space 5 and below the scanner unit 11.

The cover storing part 50 has a length substantially same as a length from the lower end of the scanner unit 11 to the upper end of the process cartridge 12 (upper end of the developing cartridge 16) in a mounting position (described later), and lengths in the front-back direction and the right-left direction are slightly longer than those in the front-back direction and the right-left direction of the photosensitive drum cover 33.

The cover storing part 50 are provided with a sensor 51 and a support rail 52.

The sensor 51 is arranged at the back of the scanner unit 11 and in the back end portion of the cover storing part 50. Specifically, the sensor 51 is arranged on a plate, and the like installed across along the right-left direction within the main body casing 2, and is placed in the left end portion so as to contact the detected part 41 of the photosensitive drum cover 33 when the photosensitive drum cover 33 is stored in the cover storing part 50.

The sensor 51 serves as a storage detecting unit configured to detect the storage of the photosensitive drum cover 33 in the cover storing part 50 and also as a destination detecting unit configured to detect a destination of the process cartridge 12. Also, the sensor 51 severs as a contact for reading information on the IC chip of the detected part 41.

Although not shown, the sensor 51 is electrically connected to a CPU in the main body casing 2, and under the condition of detection by the sensor 51, the CPU cancels the prohibition of an image forming operation of the color laser printer 1. In other words, according to a detection result of the sensor 51, the CPU controls image forming operation of the color laser printer 1.

The support rail 52 is arranged between the scanner unit 11 and the process cartridge 12 so as to extend along the front-back direction in the cover storing part 50. The support rail 52 projects inwardly from the inner-side surface of each side wall of the main body casing 2, and linearly extends along the front-back direction.

The support rail 52 inwardly projects from the inner-side surface of each side wall of the main body casing 2 by such a length that the both edges in the right-left direction of the covering plate 34 are supported from below and the exposure hole 37 is not covered when the photosensitive drum cover 33 is stored in the cover storing part 50. Moreover, the support rail 52 has the length in the front-back direction slightly longer than that in the front-back direction of the scanner unit 11.

3. Process Cartridge Mounting Operation

Figure 7:
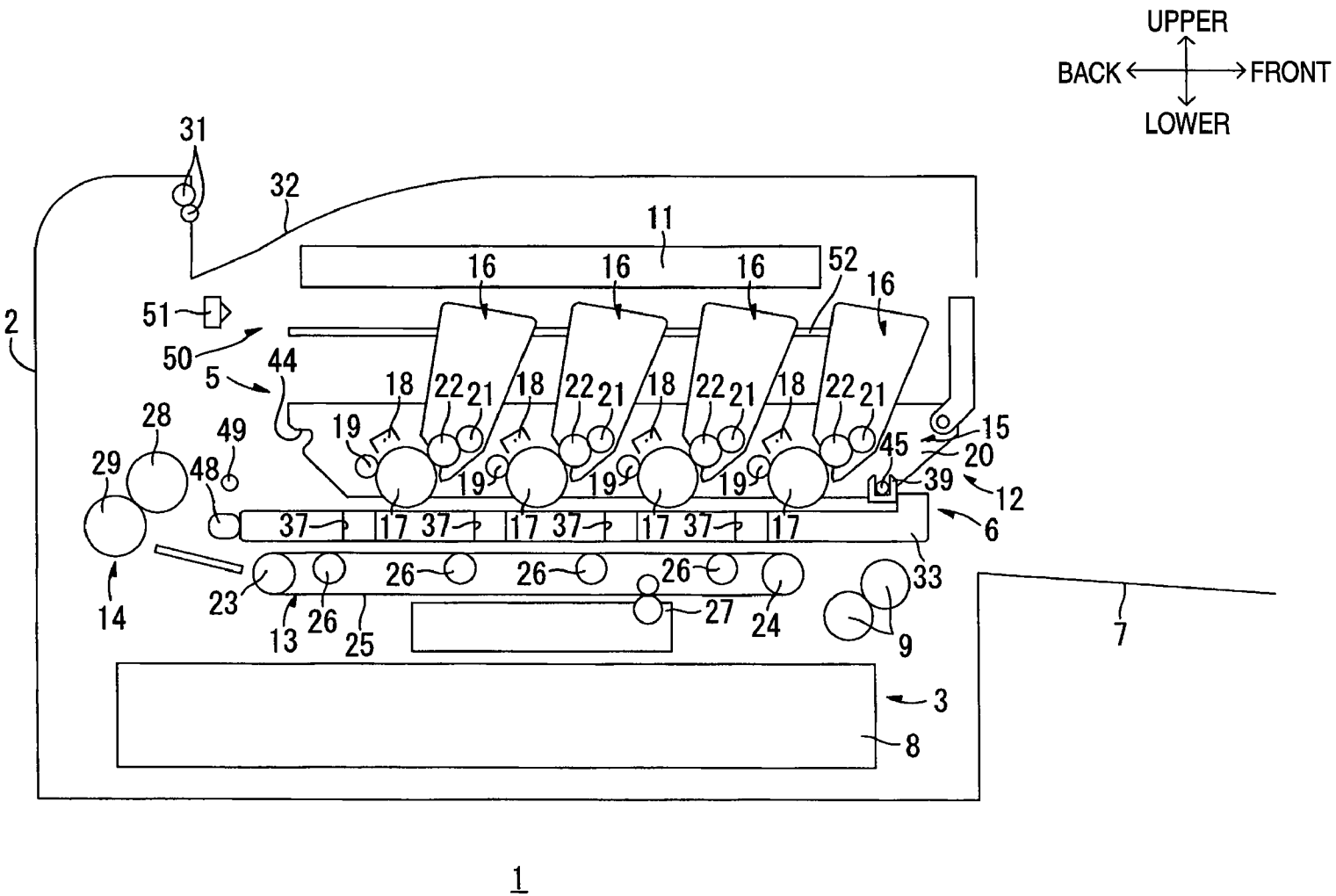
FIG. 7 is a diagram showing a step of setting the process cartridge to a mounting preparing position subsequent to the step of FIG. 6 in the step of mounting the process cartridge to the main body casing.
Figure 8:
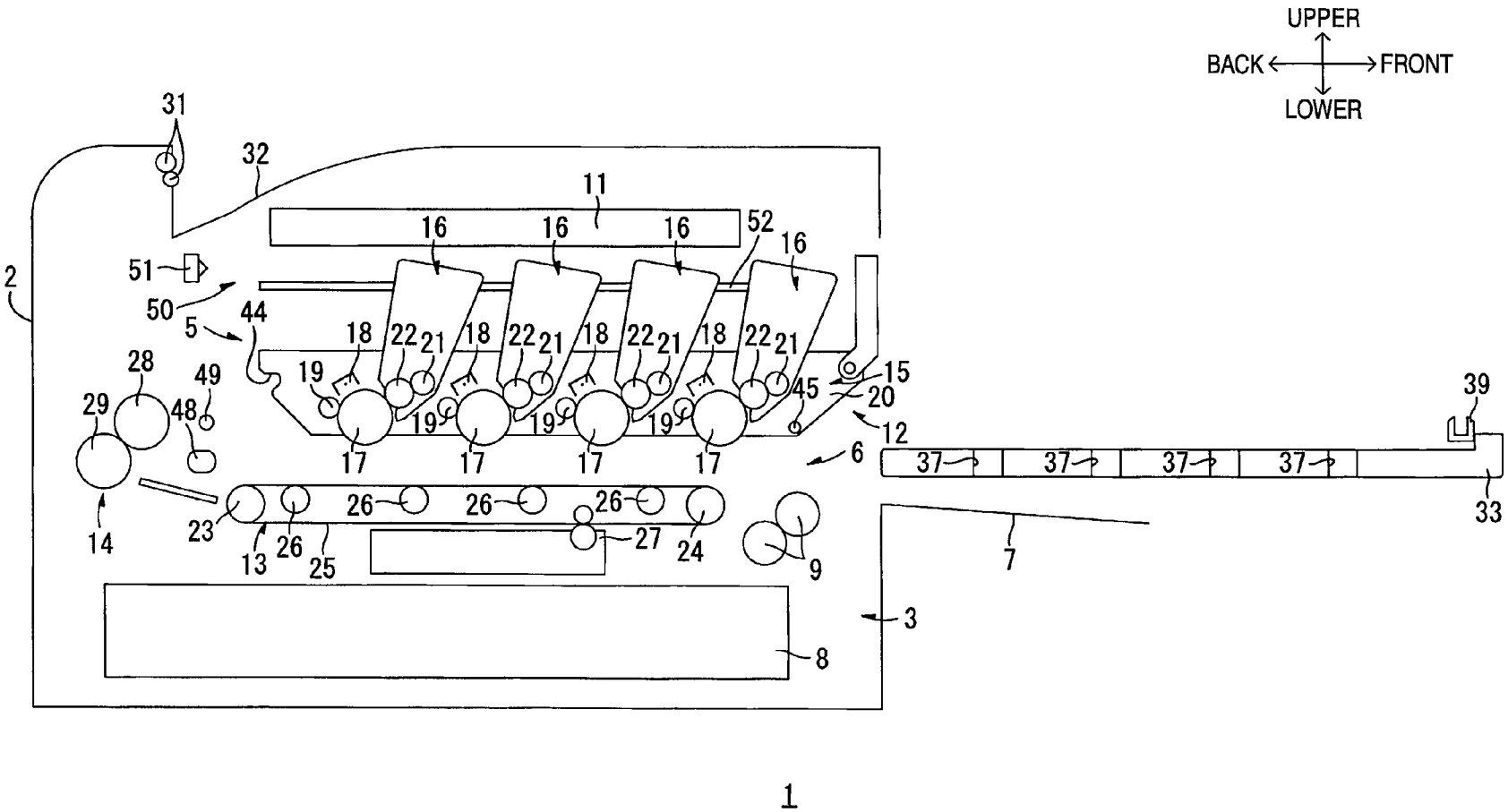
FIG. 8 is a diagram showing a step of removing the photosensitive drum cover from the process cartridge subsequent to the step of FIG. 7 in the step of mounting the process cartridge to the main body casing.
Figure 9:
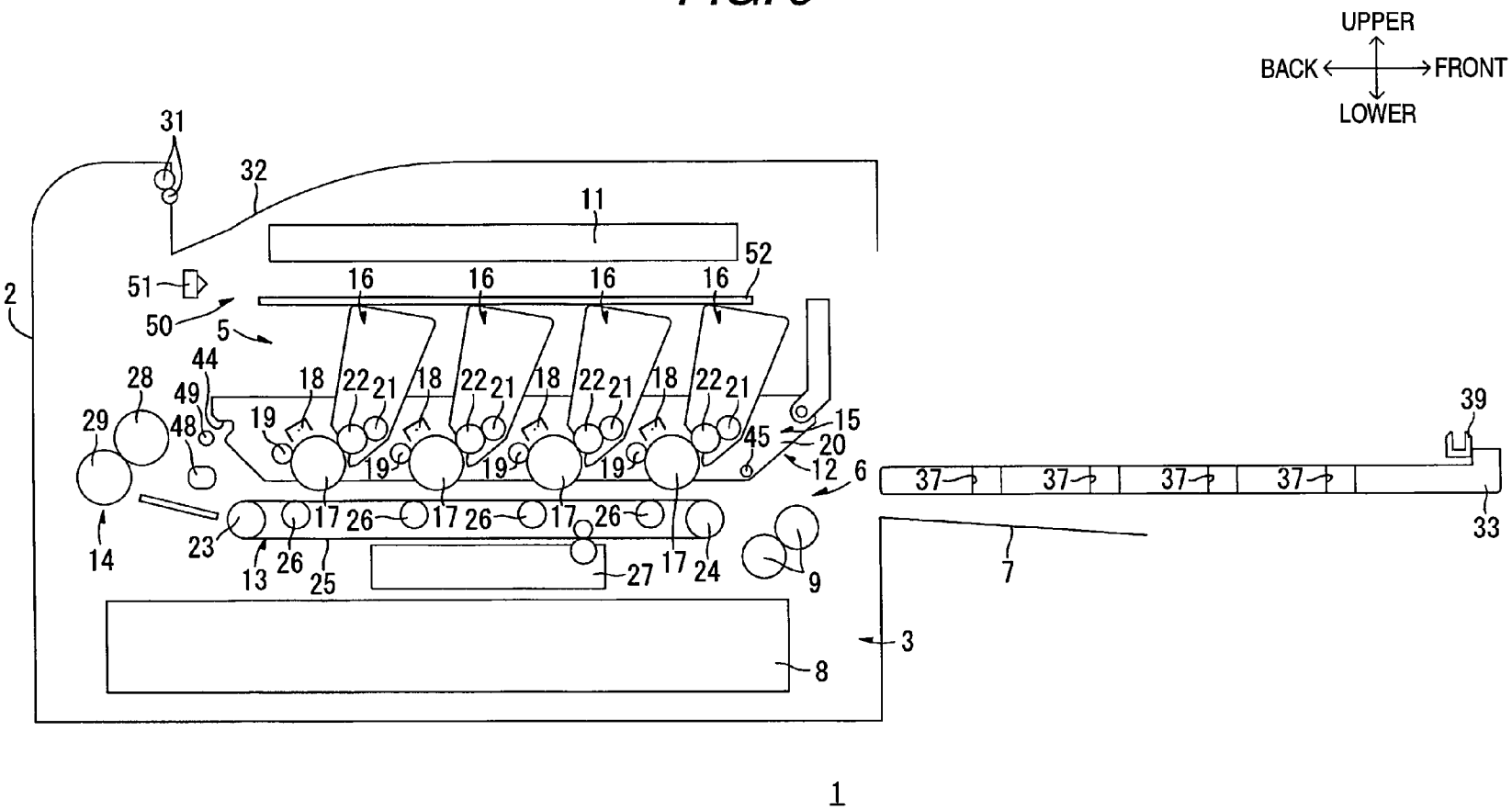
FIG. 9 is a diagram showing a step of moving the process cartridge from the mounting preparing position to a mounting position subsequent to the step of FIG. 8 in the step of mounting the process cartridge to the main body casing.

FIG. 6 to FIG. 10 show steps of mounting of the process cartridge 12 to the main body casing 2. FIG. 6 shows a step of inserting the process cartridge 12 into the process-cartridge accommodating space 5. FIG. 7 shows a step of setting the process cartridge 12 to the mounting preparing position. FIG. 8 shows a step of removing the photosensitive drum cover 33 from the process cartridge 12. FIG. 9 shows a step of moving the process cartridge 12 from the mounting preparing position to a mounting position. FIG. 10 shows a step of setting the process cartridge 12 to the mounting position.

(1) Attaching of the Photosensitive Drum Cover to the Process Cartridge

As described above, at the time of shipment from a factory, the photosensitive drum cover 33 is mounted to the process cartridge 12, as shown in FIG. 6, and is packed separately from the main body casing 2.

The photosensitive drum cover 33 is attached below the drum unit 15 when the photosensitive drum 17 is protected, as shown in FIG. 5A. At this time, each operation-information written part 36 of the covering plate 34 opposes and covers the corresponding photosensitive drum 17.

To attach the photosensitive drum cover 33 to the drum unit 15, first of all, the front end portion of the rail 46 of the process cartridge 12 is inserted between the upper-side support part 42 and the lower-side support part 43 of the backmost part of photosensitive drum cover 33.

When the photosensitive drum cover 33 is slid backwardly, the rail 46 passes between upper-side support parts 42 and lower-side support parts 43, and then, the locking shaft 45 arranged on the front side of the drum unit 15 comes into contact with the locking part 39 of the photosensitive drum cover 33.

Therefore, when the free end portion of the locking part 39 is deflected by be pressing it from above, the locking part 39 is placed below the locking shaft 45. And thereafter, when the pressing is canceled, the free end portion is restored upwardly due to the elastic force so that the locking part 39 fits with the locking shaft 45. Accordingly, the photosensitive drum cover 33 is attached to the drum unit 15.

At this time, the rail 46 is supported between the upper-side support part 42 and the lower-side support part 43, and thereby, the photosensitive drums 17 and the covering plate 34 are placed to be spaced apart from each other.

(2) Mounting of the Process Cartridge to the Main Body Casing

To mount the process cartridge 12 to the main body casing 2, at first, as shown in FIG. 6, the front cover 7 is inclined to open the removable port 6, and the process cartridge 12 (the drum unit 15 in which the photosensitive drum cover 33 is attached below) is inserted from this removable port 6 toward the process-cartridge accommodating space 5 by sliding it along the guide-rail (not shown) in a mounting direction.

As shown in FIG. 7, the back end portion (leading end portion in the mounting direction) of the photosensitive drum cover 33 is brought into contact with the stopper 48, and the process cartridge 12 is set to the mounting preparing position for mounting the process cartridge 12 to the main body casing 2.

At this time, within the cover storing part 50, the upper end of the developing cartridge 16 is placed.

Subsequently, as shown in FIG. 8, at the mounting preparing position, the photosensitive drum cover 33 is removed from the process cartridge 12. To remove the photosensitive drum cover 33 from the process cartridge 12, the handle 38 is first pressed from above so as to elastically deflect the free end portion of the handle 38. As a result, the locking part 39 moves downwardly and departs from the locking shaft 45. When the photosensitive drum cover 33 is pulled forwardly while holding the drum unit 15, the photosensitive drum cover 33 departs from the process cartridge 12.

Thereby, a space is formed between the transfer part 13 and the drum unit 15 on which the photosensitive drum cover 33 has been placed until then. This permits (enables) the movement of the process cartridge 12 from the mounting preparing position to the mounting position.

Subsequently, the process cartridge 12 is slid further backwardly to cause the process cartridge 12 to fall out of the guide-rail so that the process cartridge 12 is moved downwardly, as shown in FIG. 9.

As shown in FIG. 10, the notched part 44 arranged on the back end portion (leading end portion in the mounting direction) of the side plate 20 of the process cartridge 12 is fitted with the reference shaft 49 arranged on the main body casing 2, and thereby, the process cartridge 12 is positioned at the mounting position for mounting the process cartridge 12 so as to enable the image forming operation.

At this time, the lower end portion of the process cartridge 12 at the mounting position is placed below the lower end portion of the process cartridge 12 at the mounting preparing position, so as to be spaced further apart than the length in the upper-lower direction of the photosensitive drum cover 33.

Since the process cartridge 12 is moved downwardly from the mounting preparing position, the upper end of the developing cartridge 16 is retracted downwardly from inside the cover storing part 50. Therefore, a space as large as to store the photosensitive drum cover 33 is formed inside the cover storing part 50.

Thereafter, the photosensitive drum cover 33 is stored in the cover storing part 50. To store the photosensitive drum cover 33 in the cover storing part 50, the lower-end surface of the both end portions in the right-left direction of the photosensitive drum cover 33 is placed (received) on the upper-end surface of the support rail 52, and slid toward the backside. Thereafter, the detected part 41 of the photosensitive drum cover 33 is brought into contact with the sensor 51 of the cover storing part 50. As a result, the sensor 51 detects the storing of the photosensitive drum cover 33 in the cover storing part 50 and also detects the destination of the process cartridge 12, and the image forming operation prohibited until then is enabled by the CPU (not shown). This completes the mounting of the process cartridge 12 to the main body casing 2.

It is noted that the sensor 51 is placed in a different position in the right-left direction for each destination so as to detect the destination of the process cartridge 12.

That is, since the sensor 51 is placed at the left end portion in the main body casing 2, when the detected part 41 is placed at the left end portion of the photosensitive drum cover 33, the contact point of the sensor 51 and the IC chip of the detected part 41 come in contact, thereby detecting the destination. On the other hand, when the destination differs and the detected part 41 is placed at the right end portion of the photosensitive drum cover 33, as shown by a virtual line in FIG. 3, the contact point of the sensor 51 and the IC chip of the detected part 41 do not come in contact, and thus, the destination is not detected. Therefore, when the process cartridge 12, the destination of which differs, is set to the main body casing 2, the CPU does not cancel the prohibition of the image forming operation, and thus, the color laser printer 1 is not caused to carry out the image forming operation. Consequently, it becomes possible to suppress the mounting of the process cartridge 12, the destination of which differs, to the main body casing 2.

Thereafter, when necessary, a user may pull out the photosensitive drum cover 33 from the cover storing part 50 so as to confirm the information written in the operation-information written part 36.

4. Operation and Effect (1) In the color laser printer 1, as shown in FIG. 5A, the photosensitive drum cover 33 for protecting the four photosensitive drums 17 provided in the process cartridge 12 includes the covering plate 34 configured to oppose the four photosensitive drums 17 so as to cover the four photosensitive drums 17, and the operation-information written part 36 is arranged on the covering plate 34.

That is, it is possible to write the operation information of the color laser printer 1 in the operation-information written part 36 of the covering plate 34 on which an area opposing the four photosensitive drums 17 can be secured. Therefore, the operation information of the color laser printer 1 can be presented in a large area. As a result, the erroneous operation of the color laser printer 1 can be suppressed.

Moreover, the operation-information written part 36 is arranged on the covering plate 34 for protecting the photosensitive drums 17, and thus, it is not necessary to provide separate components for being written with the operation information. Therefore, it is possible to decrease the number of components, reduce cost, and make the apparatus compact.

Moreover, the operation information of the color laser printer 1 is written on the photosensitive drum cover 33, and thus, it is possible to suppress the user of the color laser printer 1 from discarding the photosensitive drum cover 33. Therefore, when re-packing is required due to repair, and the like, the photosensitive drums 17 can be protected again by the photosensitive drum cover 33.

(2) Moreover, in this color laser printer 1, as shown in FIG. 1, the cover storing part 50 for storing the photosensitive drum cover 33 is arranged in the main body casing 2. Therefore, when the photosensitive drum cover 33 is stored in the cover storing part 50, it is easy to manage the protective members, and besides, the operation information can be seen at any time.

As a result, the erroneous operation of the color laser printer 1 can be further prevented.

(3) Moreover, as shown in FIG. 1, the cover storing part 50 is placed between the scanner unit 11 and the drum unit 15 in the color laser printer 1. Therefore, the space between the scanner unit 11 and the drum unit 15 can be effectively utilized as the cover storing part 50.

As a result, the photosensitive drum cover 33 can be efficiently stored in the color laser printer 1.

(4) Moreover, in the laser printer 1, as shown in FIG. 3, the covering plate 34 is formed with the exposure holes 37 for passing the light emitted from the scanner unit 11 toward the photosensitive drum 17. Further, the exposure holes 37 respectively oppose the windows (not shown) for emitting a laser beam, of the scanner unit 11 in the upper-lower direction. Therefore, the light emitted from the scanner unit 11 passes through the exposure holes 37 of the covering plate 34, and thus, the photosensitive drums 17 can be reliably exposed.

As a result, the photosensitive drums 17 can be reliably exposed, and also the photosensitive drum cover 33 can be efficiently stored in the color laser printer 1.

(5) Moreover, as shown in FIG. 1, the color laser printer 1 is provided with the sensor 51 for detecting the storing of the photosensitive drum cover 33 in the cover storing part 50, and under the condition of detection by the sensor 51, the image forming operation is enabled. Therefore, unless the photosensitive drum cover 33 is stored in the cover storing part 50 after removing the photosensitive drum cover 33 from the drum unit 15, the color laser printer 1 does not operate. Thus, it is possible to prompt the user to reliably store the photosensitive drum cover 33 in the cover storing part 50, thereby further suppressing the discarding of the photosensitive drum cover 33 by the user.

(6) Further, in the color laser printer 1, the sensor 51 for detecting the storing of the photosensitive drum cover 33 in the cover storing part 50 also detects the destination of the process cartridge 12, and under the condition of detection by the sensor 51, the image forming operation is enabled.

This makes it possible to detect the destination of the process cartridge 12 without increasing the number of components. As a result, it becomes possible to suppress the drum unit 15 that has a different destination from being mounted to the color laser printer 1.

(7) Further, in the color laser printer 1, in order to mount the process cartridge 12 to the main body casing 2, at first, the back end portion of the photosensitive drum cover 33 attached below the drum unit 15 is brought into contact with the stopper 48, as shown in FIG. 7. Thereafter, the process cartridge 12 is set to the mounting preparing position.

Subsequently, as shown in FIG. 8, when the photosensitive drum cover 33 is removed from the drum unit 15 at the mounting preparing position, it becomes possible to move the process cartridge 12 from the mounting preparing position to the mounting position. That is, the lower end portion of the process cartridge 12 at the mounting position is placed below the lower end portion of the process cartridge 12 at the mounting preparing position to be spaced further apart than the length in the upper-lower direction of the photosensitive drum cover 33. Thus, it becomes possible to move it downwardly to be spaced further apart than the length in the upper-lower direction of the photosensitive drum cover 33 that has been attached.

Then, the process cartridge 12 is moved downwardly from the mounting preparing position, as shown in FIG. 9, and the notched part 44 of the process cartridge 12 is fitted with the reference shaft 49, as shown in FIG. 10. Thereby, the process cartridge 12 can be mounted to the main body casing 2 in a manner to enable the image forming operation.

As a result, it becomes possible to mount the process cartridge 12 to the main body casing 2 by reliable positioning, and also protect the photosensitive drums 17 until immediately before the mounting position because the photosensitive drum 17 is protected up to the mounting preparing position when the process cartridge 12 is mounted to the main body casing 2.

5. Modification

In the above-described exemplary embodiment, the detected part 41 is provided with the IC chip, and the sensor 51 is arranged as a contact point for reading the information on the IC chip of the detected part 41. However, the detected part 41 may not be provided with the IC chip, and the sensor 51 can be configured as a mechanical switch (pressure switch) such as a limit switch. In this case, the sensor 51 and the detected part 41 come in contact to detect the destination.

Moreover, when the sensor 51 is a mechanical switch (pressure switch) such as a limit switch, the image forming operation may be enabled based on non-detection by the sensor 51 without any contact between the detected part 41 and the sensor 51.

For example, the detected part 41 is formed as a concave part notched in a portion corresponding to the sensor 51 of the back end portion of the photosensitive drum cover 33 so that the back end portion of the photosensitive cover 33 does not come in contact with the sensor 51. By doing so, even when the photosensitive drum cover 33 is attached to the cover storing part 50, the detected part 41 does not come in contact with the sensor 51. Therefore, the sensor 51 can cancel the prohibition of the image forming operation, under the condition of non-detection of the detected part 41.

Moreover, in the above-described exemplary embodiment, although the cover storing part 50 is placed between the scanner unit 11 and the process cartridge 12, there is no particular limitation. For example, it is possible to place the cover storing part 50 below the sheet feed tray 8. As a result, the exposure holes 37 need not be arranged in the photosensitive drum cover 33, and also, the area for being written with the operation information can be secured.

What is claimed is:

1. An image forming apparatus comprising:

a casing;

a photosensitive unit removably mountable in the casing, and comprising a plurality of photosensitive members; and a protective member removably attached to the photosensitive unit, and configured to protect the plurality of photosensitive members, the protective member comprising:

a covering plate which opposes the plurality of photosensitive members to cover the plurality of photosensitive members when protecting the photosensitive members;

a written part arranged on the covering plate, and including operation information related to the image forming apparatus written thereon; and a support part which supports the photosensitive unit so that the photosensitive members and the covering plate are separated by an interval when protecting the photosensitive members.

2. The image forming apparatus according to claim 1, wherein the casing comprises a storing part configured to store the protective member.

3. The image forming apparatus according to claim 2, wherein the casing comprises an exposure unit configured to expose the photosensitive members above the photosensitive unit, and wherein the storing part is arranged between the exposure unit and the photosensitive unit.

4. The image forming apparatus according to claim 3, wherein the covering plate is formed with an opening for passing though a light emitted from the exposure unit, the opening penetrating through the covering plate in a thickness direction.

5. The image forming apparatus according to claim 2, wherein the casing comprises a storage detecting unit configured to detect storing of the protective member in the storing part, and wherein according a detection result of the storage detecting unit, an image forming operation of the image forming apparatus is enabled.

6. The image forming apparatus according to claim 1, wherein the casing comprises a destination detecting unit configured to detect a destination of the photosensitive unit, and wherein according to a detection result of the destination detecting unit, an image forming operation of the image forming apparatus is enabled.

7. The image forming apparatus according to claim 1, wherein the photosensitive unit is mounted in the casing in a mounting direction, and wherein the casing comprises:

a first contact part which contacts a leading end portion of the protective member in the mounting direction at a mounting preparing position for mounting, to the casing, the photosensitive unit attached with the protective member therebelow; and a second contact part which contacts the leading end portion of the photosensitive unit in the mounting direction at a mounting position for mounting, to the casing, the photosensitive unit without the protective member to enable an image forming operation, wherein by removing the protective member from the photosensitive unit at the mounting preparing position, movement of the photosensitive unit from the mounting preparing position to the mounting position is enabled, and wherein a lower end portion of the photosensitive unit at the mounting position is arranged lower than the lower end portion of the photosensitive unit at the mounting preparing position by a length longer than the protective member in an upper-lower direction.

8. The image forming apparatus according to claim 2, wherein the casing comprising a receiving part, and wherein the receiving part receives the protective member so that the protective member is stored in the storing part.

9. The image forming apparatus according to claim 8, wherein the receiving part receives a lower end of the protective member.

10. The image forming apparatus according to claim 5, wherein the protective member comprises a IC chip, and wherein the storage detecting unit comprises a sensor configured to contact the IC chip of the protective member to detect the storing of the protective member.

11. The image forming apparatus according to claim 6, wherein the protective member comprises a detected part, a position of which varies according to a destination of the photosensitive unit, wherein the destination detecting unit detects the destination of the photosensitive unit based on the position of the photosensitive unit.

12. A photosensitive unit set comprising:

a photosensitive unit removably mountable in a casing of an image forming apparatus, the casing comprising a storing part, the photosensitive unit comprising:

a body; and a plurality of photosensitive drums rotatably supported by the body, each photosensitive drum includes an exposed portion which is exposed from the body; and a protective member removably attached to the body, and opposing the exposed portions of the plurality of photosensitive drums to protect the exposed portions when attached to the body, the protective member being adapted to be stored in the storing part of the casing when removed from the body.

13. The photosensitive unit set according to claim 12, wherein the body comprises a first receiving part, wherein the casing comprises a second receiving part, wherein the protective member comprises an attaching part which is received on the first receiving part when the protective member is attached to the body, and wherein a lower end of the protective member is received on the second receiving part when the protective member is stored in the storing part.

14. The photosensitive unit set according to claim 13, wherein the first receiving part includes a first rail, wherein the second receiving part includes a second rail, wherein the attaching part slidably contacts the first rail, and the lower end slidably contacts the second rail.

15. The photosensitive unit set according to claim 12, wherein the casing comprises a detecting unit, wherein the protective member includes a detected part, the detected part being adapted to contact the detecting unit when the protective member is stored in the storing part.

16. A photosensitive unit set comprising:

a photosensitive unit removably mountable in a casing of an image forming apparatus, the photosensitive unit comprising a plurality of photosensitive members arranged in parallel with each other; and a protective member removably attached to the photosensitive unit, and configured to protect the plurality of photosensitive members, the protective member comprising:

a covering plate which opposes the plurality of photosensitive members to cover the plurality of photosensitive members when protecting the photosensitive members;

a written part arranged on the covering plate, and including operation information related to the image forming apparatus written thereon; and a support part which supports the photosensitive unit so that the photosensitive members and the covering plate are separated by an interval when protecting the photosensitive members.

17. The photosensitive unit set according to claim 16, wherein the covering plate is formed with a plurality of openings penetrating through the covering plate in a thickness direction.

18. The photosensitive unit set according to claim 16, wherein the protective member further comprises a peripheral-wall part which is formed to continue from a peripheral edge of the covering plate and is erected toward the photosensitive unit so as to surround the covering plate.

19. The photosensitive unit set according to claim 16, wherein the protective member further comprises a handle which has a fixed end portion continuing from the covering plate and a free end portion provided at an opposite side of the fixed end portion, and wherein the free end portion is provided with a locking part configured to lock with a locked part of the image forming apparatus.

20. The photosensitive unit set according to claim 19, wherein the handle is provided at an upstream side of the protective member in a mounting direction of the photosensitive unit.

* * * * *